US010721961B2

(12) United States Patent
Aladin

(10) Patent No.: US 10,721,961 B2
(45) Date of Patent: Jul. 28, 2020

(54) SYSTEMS AND DEVICES FOR MATERIAL RECLAIM

(71) Applicant: Shan Aladin, Vashon, WA (US)

(72) Inventor: Shan Aladin, Vashon, WA (US)

( * ) Notice: Subject to any disclaimer, the term of this patent is extended or adjusted under 35 U.S.C. 154(b) by 433 days.

(21) Appl. No.: 15/669,777

(22) Filed: Aug. 4, 2017

(65) Prior Publication Data

US 2019/0037914 A1 Feb. 7, 2019

(51) Int. Cl.
*A24F 9/00* (2006.01)
*A24F 1/30* (2006.01)

(52) U.S. Cl.
CPC . *A24F 9/00* (2013.01); *A24F 1/30* (2013.01)

(58) Field of Classification Search
None
See application file for complete search history.

(56) References Cited

U.S. PATENT DOCUMENTS 2,205,553 A * 6/1940 Blair ..... A24F 1/00
131/202

FOREIGN PATENT DOCUMENTS

GB 159476 A * 2/1922 ..... A24F 1/00

* cited by examiner

*Primary Examiner* — Michael J Felton
(74) *Attorney, Agent, or Firm* — Gleam Law, PLLC; Neil Juneja

(57) ABSTRACT

Systems and devices for material reclaim of unutilized and underutilized inhalation products and to trap refuse, including an inlet, funnel member, reclaim bowl, and a housing. Additional components may include and upper and lower adapter.

18 Claims, 6 Drawing Sheets

SYSTEMS AND DEVICES FOR MATERIAL RECLAIM

BACKGROUND

Since before the dawn of civilization, humans have been administering herbs and other plants by any effective means possible. First, early man realized that certain foods provided beneficial effects. Over time, the wisest of the tribes discovered that some herbs, roots, and other natural components have curative properties. The administration of compounds through food or water was the most common and intentional methods used by our ancestors. Later, the civilized people discovered the effects of topical applications. Eventually, particulates suspended in air and administered through pulmonary application were discovered.

The first inhalants were consumed by inhaling smoke, presumably discovered when certain plant matter was burned in a campfire and the tribal "doctor" drew the connection between the inhalation of smoke and the effects on his people. Subsequently, efficient methods of harnessing the smoke were developed. Medicine pipes were invented and revered, utilized for smoking tobacco, *Cannabis sativa* L., and opium, among others. In some cases, sophisticated traditions were created around smoking of a pipe. In time, cigarettes were also created.

Almost every culture across the world used local materials and knowledge to create new designs of pipes to achieve an easy and effective method of smoking. In the sixteenth and seventeenth centuries, the hookah and water pipe were introduced in Europe following the introduction of tobacco from the new world. The first bong, made of gold, was discovered in Russia, dating back 2,400 years, believe be used for *cannabis* and opium. The water pipe was introduced in China during the late Ming Dynasty along the silk road, also for smoking tobacco. The addition of water into the smoking device allowed for cooling and filtering of the smoke. Water filtration provided a healthier and preferred smoke.

Throughout the history of smoking, concentrated forms of the active components have been with a desire to increase desired effects while mitigating undesirable side effects. With tobacco, nicotine oil is commonly vaporized. With *cannabis*, hash and kief, concentrating the trichomes and terpenes were the first concentrates. Over the past twenty years, technological development of extraction methods have produced potent *cannabis* extracts. Extraction methods include solventless extraction (e.g. cold water, rosen press) or solvents such as petroleum derived hydrocarbons (e.g. butane, toluene, trimethylpentane), low molecular weight alcohol (e.g. ethanol, isopropyl, grain alcohol), low molecular weight hydrocarbon (e.g. chloroform, dichloromethane), and supercritical fluid with or without organic solvent. The results are extracts with varying viscosity which can reach cannabinoid (secondary metabolites of *cannabis*) content greater than 90%, whereas the nonextracted plant ranges from 3% to 30% cannabinoid content by weight. Some common names for the extraction materials include oil, wax, dabs, crumble, budder, BHO (Butane Hash Oil), distillate, and shatter.

Extraction materials are not ordinarily combusted with an ordinary lighter for inhalation. The act of "dabbing" utilizes a blowtorch or electric device for vaporizing the material. I most common apparatus utilized in *cannabis* smoking culture is a nail, constructed out of titanium, ceramic, quartz, or similar compositions. The material is placed upon the nail and is heated electrically to the desired temperature. Nails are placed at the bowl component of a water pipe (also known as a bong) or other smoking device. As the material is heated by electric or blowtorch means, the material will vaporize or combust, allowing the user to inhale the vapor/smoke through the smoking device. The remaining material will break apart, melt, or otherwise lose its cohesion. The results in lost material.

Therefore, a need exists for a material reclaim system in order to reduce waste associated with conventional substance inhalation apparatuses.

SUMMARY

In an aspect, the present disclosure is directed to, among other things, representative embodiments of a material reclaim system. The system generally includes a funnel positioned above a reclaim bowl, where the reclaim bowl is configured to collect condensation of the source material for reuse.

In accordance with one embodiment described herein, a material reclaim system is provided. The material reclaim system generally includes an inlet configured to draw an inhalant into the material reclaim system; a funnel member positioned adjacent the inlet and having a funnel spout; a reclaim bowl partially surrounding the funnel spout; and a housing surrounding the funnel member and the reclaim bowl. The housing generally includes an articulating joint and an outlet for expelling the inhalant, wherein the funnel spout may be configured to direct the inhalant into the reclaim bowl such that condensate collects therein.

In accordance with another embodiment described herein, a material reclaim system for an inhalation apparatus is provided. The material reclaim system generally includes an upper adapter having an inlet configured to draw an inhalant into the material reclaim system, the upper adapter configured to retain a receptacle containing a source material; a funnel member positioned adjacent the inlet and having a funnel spout; a reclaim bowl partially surrounding the funnel spout; a housing surrounding the funnel member and the reclaim bowl; and a lower adapter couplable to the housing and having an outlet configured to expel the inhalant, the lower adapter configured to interface the material reclaim system with the inhalation apparatus, wherein the funnel spout may be configured to direct the inhalant into the reclaim bowl such that condensate collects therein.

In accordance with any of the embodiments described herein, the system may further include an upper adapter interfacing the inlet and configured to retain a receptacle containing a source material.

In accordance with any of the embodiments described herein, the upper adapter may further include a receptacle adapter seat such that the receptacle abuts the adapter seat in a retained position.

In accordance with any of the embodiments described herein, the upper adapter may further include a plate positioned adjacent the funnel member to enclose the reclaim housing.

In accordance with any of the embodiments described herein, the system may further include a lower adapter interfacing the outlet and configured to couple the material reclaim system to an inhalation apparatus.

In accordance with any of the embodiments described herein, the lower adapter may further include an inhalation apparatus adapter seat such that the inhalation apparatus abuts the inhalation apparatus adapter seat when the material reclaim system is coupled to the inhalation apparatus.

In accordance with any of the embodiments described herein, the articulating joint may be configured to position the material reclaim system at an angle compared to the inhalation apparatus.

In accordance with any of the embodiments described herein, the reclaim bowl may include a vent such that inhalant exits the reclaim bowl and flows to the outlet.

In accordance with any of the embodiments described herein, the funnel spout may be arcuate.

In accordance with any of the embodiments described herein, the funnel, reclaim bowl, and housing may be in a nested configuration.

In accordance with any of the embodiments described herein, the system may be manufactured from one or more of High-Density Polyethylene (HDPE), Low-Density Polyethylene (LDPE), rubber, Polypropylene (PP), nylon, Acrylonitrile Butadiene Styrene (ABS), Polybutylene Terephthalate (PBT), metal, and glass.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
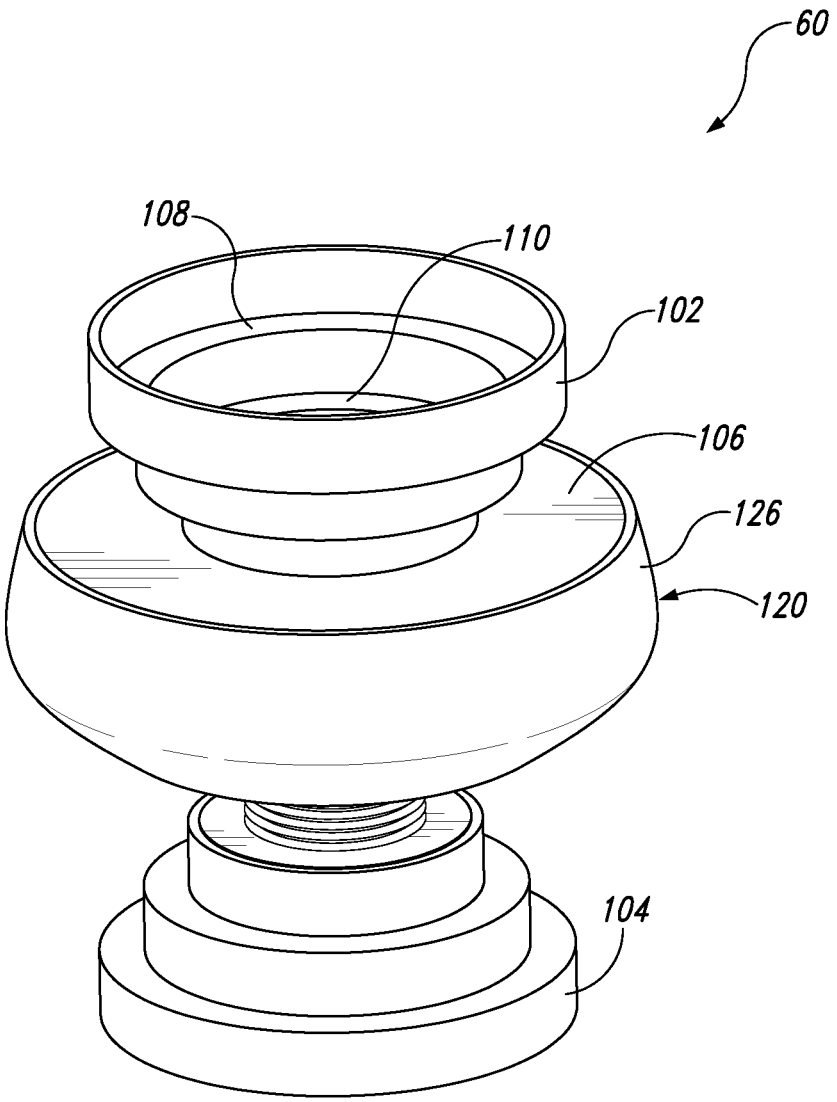
FIG. 1 is a front top perspective view of one representative embodiment of a material reclaim system in accordance with an aspect of the present disclosure.

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The following description provides several examples that relate to systems and devices for material reclaim, such as systems used with an apparatus for inhalation of various vapors, gases, and smoke. During the process of heating and emitting the vapor, gas, or smoke, some of the material may condense, or the source material may otherwise escape the receptacle where the source material is contained. In this regard, the material may be reclaimed with the systems of the present disclosure for reuse, thereby reducing the amount of waste. When the material is collected by the material reclaim system described herein, the collected material can be added to the source material in the receptacle or stored separately for later use, among other uses. In some embodiments, the material reclaim system is integrated into the inhalation apparatus.

FIG. 1 shows one representative embodiment of a material reclaim system, in accordance with an aspect of the present disclosure, for implementing one or more inventive methodologies or technologies such as, for example, providing a system for collecting and storing condensation of source material. In the description herein, the term "source material" should be interpreted to define any solid or liquid material suitable for creating inhalants, for example oils, waxes, shatters, dabs, distillates, etc. In a similar regard, the term "inhalants" should be construed as any vapor, gas, smoke, and any combination thereof, created from the heating, burning, outgassing, or melting of the source material.

Conventional inhalation apparatuses can exhibit poor efficiency at converting source material to inhalant. As a result, use of the apparatus may cause waste of the source material. Accordingly, to address the deficiencies of conventional inhalation apparatuses, and/or others, embodiments of the present disclosure relate to a material reclaim system that promotes the return of accumulated source material to the receptacle. In the description herein, the term "receptacle" refers to any suitable depository for the source material. In some embodiments, the receptacle is configured to heat or burn the source material such that the inhalant is emitted. The types of receptacles used with certain embodiments of the material reclaim system of the present disclosure are generally known in the art and are therefore not depicted in the FIGURES. Examples of receptacles suitable for use with the material reclaim system are: a nail and a melting point apparatus, among others.

Figure 6:
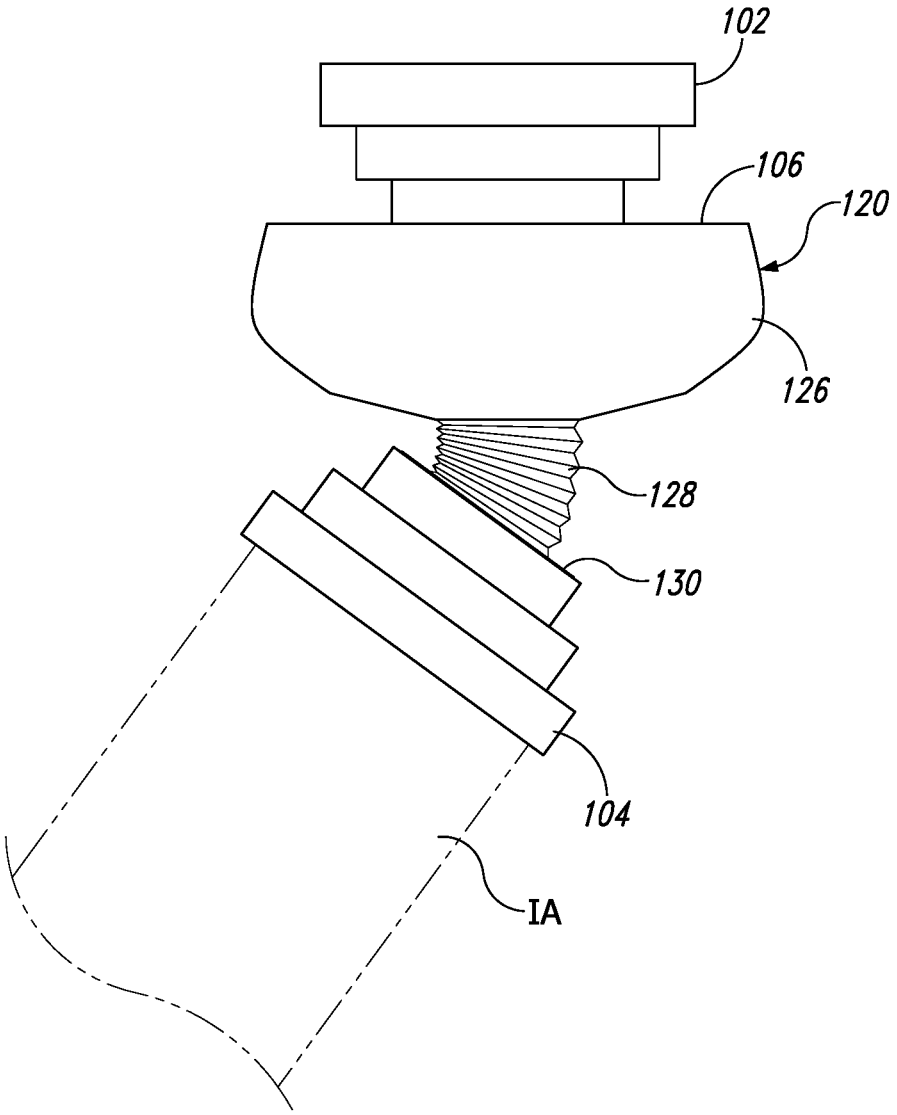
FIG. 6 is a front environmental view of the material reclaim system of FIG. 1, showing the lower adapter in an articulated configuration.

Likewise, the term "inhalation apparatus" used herein refers to any suitable apparatus for directing the inhalant generated within the receptacle to a user's lungs. In some embodiments, the inhalation apparatus is configured to direct the inhalant through a filter or a liquid, such as water, before it is directed to the user's lungs. The types of inhalation apparatuses used with embodiments of the material reclaim system of the present disclosure are generally known in the art and are therefore not depicted in the FIGURES; however, one exemplar embodiment of an inlet portion of an inhalation apparatus IA is shown in FIG. 6. Examples of inhalation apparatuses suitable for use with the material reclaim system are: a water pipe; a bong; a dab rig; an electric coil apparatus; forced induction devices; pressurized devices; dynamic gas methods; among others.

Embodiments of the material reclaim system disclosed herein are suitable for use with various sizes and shapes of inhalation apparatuses and receptacles, among other uses. In one embodiment, the material reclaim system generally includes an upper adapter, a lower adapter, and a reclaim body. The upper adapter is configured to interface with a receptacle containing the source material. The lower adapter is configured to interface with an inlet portion of the inhalation apparatus. In some embodiments, the upper and lower adapters are capable of interfacing receptacles and inhalation apparatus inlet portions of different sizes and configurations, as will be explained in greater detail below.

Referring now to the FIGURES, there is shown one embodiment of a material reclaim system, generally designated 100, in accordance with one or more aspects of the present disclosure. In the illustrated embodiment, the material reclaim system 100 generally includes an upper adapter 102, a lower adapter 104, and a reclaim body assembly 120. When assembled for use, the upper adapter 102 interfaces the receptacle to provide a coupling for the receptacle and create a path to draw the inhalant into the material reclaim system 100. In some embodiments, the upper adapter 102 includes features to closely interface different sizes and types of receptacle. In the illustrated embodiment, the upper adapter 102 has a first upper adapter seat 108 and a second upper adapter seat 110. In the configuration shown, the first upper adapter seat 108 has a diameter larger than the second upper adapter seat 110, such that the first upper adapter seat 108 is configured to interface a larger sized receptacle, while the second upper adapter seat 110 is configured to interface a mid-sized receptacle. Further, a smaller sized receptacle can interface with the inlet of the upper adapter 102. If the second upper adapter seat 110 is used, the receptacle will seat closer to the reclaim body assembly 120 than if the first upper adapter seat 108 is used, etc. In other embodiments, the upper adapter 102 includes any number of adapter seats such that the upper adapter 102 suitably interfaces any size receptacle.

When assembled for use, the lower adapter 104 interfaces the inhalation apparatus IA to provide a coupling for the receptacle and the material reclaim system 100 to the inhalation apparatus IA, and to create a path to draw the inhalant from the material reclaim system into the inlet portion of the inhalation apparatus IA. In some embodiments, the lower adapter 104 includes features to closely interface different sizes and types of inhalation apparatus inlet. In the illustrated embodiment, the lower adapter 104 has a first lower adapter seat 112 and a second lower adapter seat 114, and a lower adapter cover 130 seated in an upper protrusion 116 of the lower adapter 104. In the configuration shown, such as in FIG. 3, the first lower adapter seat 112 has a diameter larger than the second lower adapter seat 114, such that the first lower adapter seat 112 is configured to interface a larger sized inhalation apparatus inlet, while the second lower adapter seat 114 is configured to interface a mid-sized inhalation apparatus inlet. Further, a smaller sized inhalation apparatus inlet can interface with the lower adapter cover 130 of the lower adapter 104. If the second lower adapter seat 114 is used, the inhalation apparatus inlet will insert further into the lower adapter 104 and will be closer to the reclaim body assembly 120 than if the first lower adapter seat 112 is used. In other embodiments, the lower adapter 104 includes any number of adapter seats such that the lower adapter 104 suitably interfaces any size receptacle.

In the illustrated embodiment, the lower adapter 104 includes the lower adapter cover 130. In a similar manner to the upper adapter cover 106, described above, the lower adapter cover 130 interfaces an articulating joint 128 (described below in greater detail) of the reclaim body 126 such that the inhalant is contained within the material reclaim system 100, and to prevent dirt and contaminants from entering the reclaim body assembly 120. Although the lower adapter cover 130 is depicted as combined with the lower adapter 104, in other embodiments, the lower adapter cover 130 is suitably a separate component that interfaces both the lower adapter 104 and the reclaim housing 126, or is suitably combined with the articulating joint 128 of the reclaim body 126 or any other component of the material reclaim system 100. Each component of the reclaim body assembly 120 will now be described in greater detail.

Figure 2:
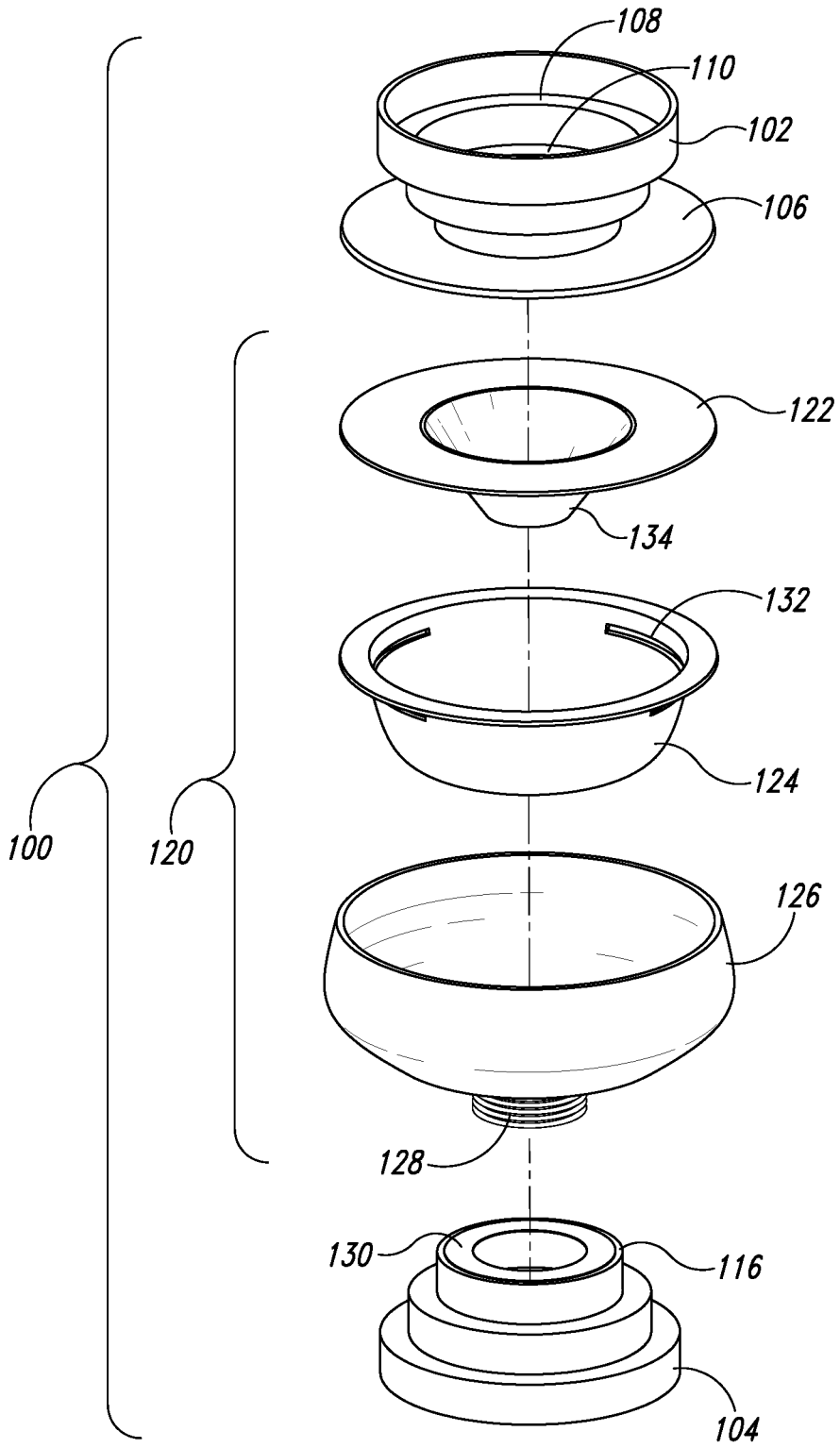
FIG. 2 is a front top exploded perspective view of the material reclaim system of FIG. 1.
Figure 3:
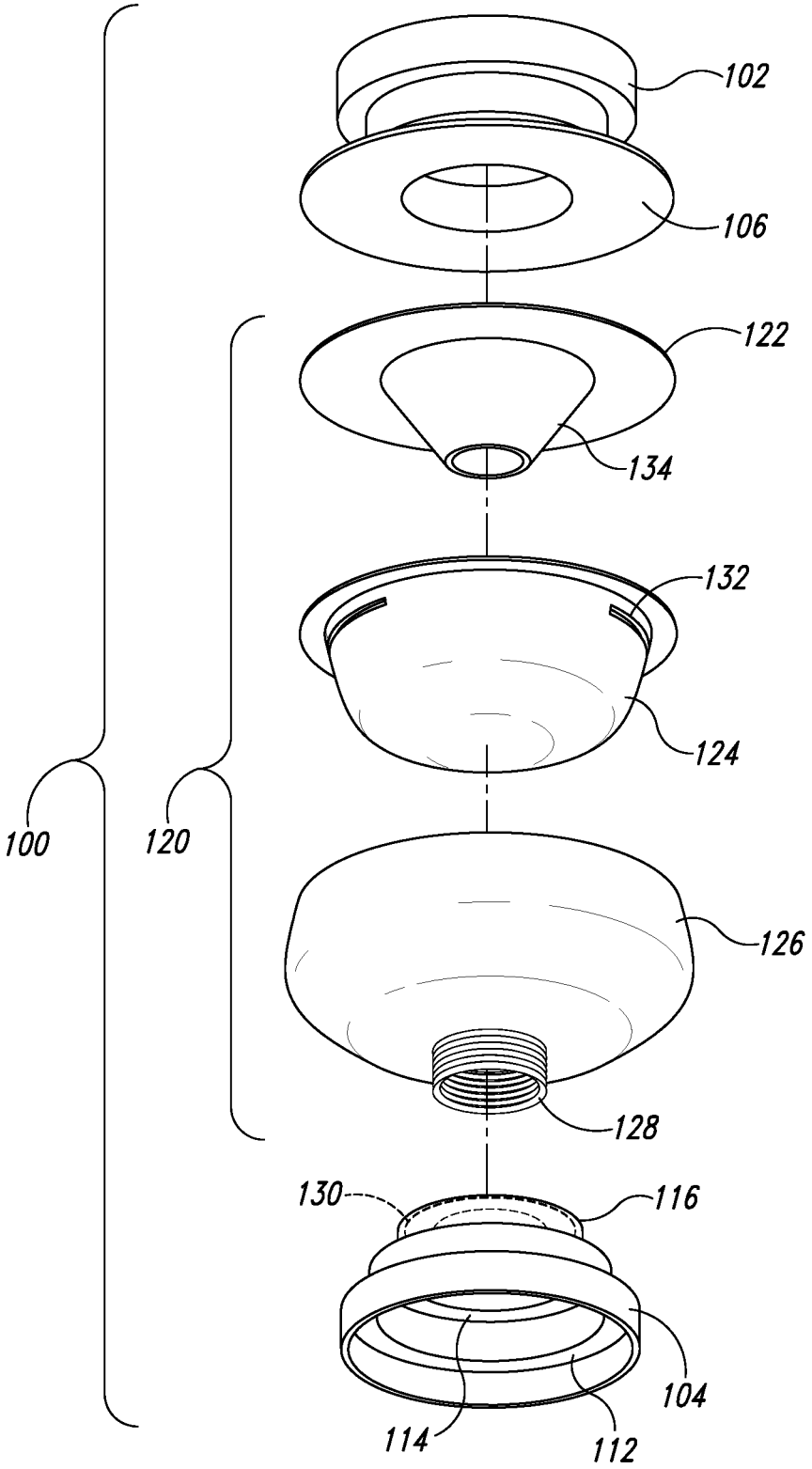
FIG. 3 is a front bottom exploded perspective view of the material reclaim system of FIG. 1.
Figure 5:
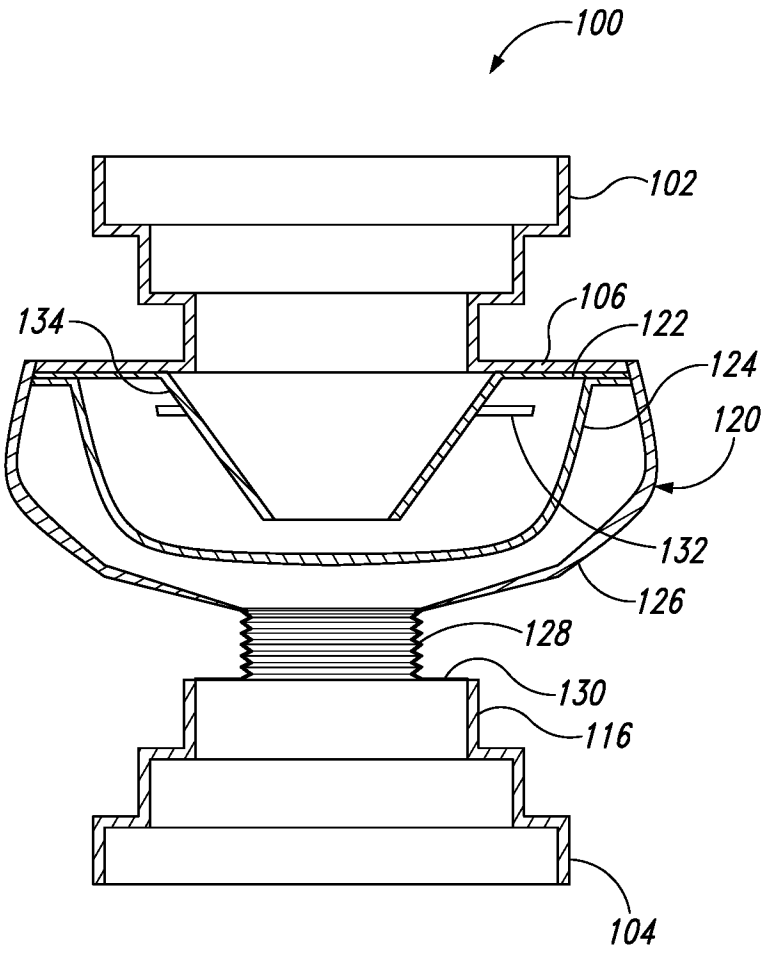
FIG. 5 is a front cross-sectional view of the material reclaim system of FIG. 1.

Turning to FIGS. 2, 3, and 5, the reclaim body assembly 120 includes a funnel member 122, a reclaim bowl 124, and a reclaim housing 126. The reclaim housing 126 provides a protective housing for the reclaim body assembly 120 to interface the upper adapter 102 and the lower adapter 104, retain the inhalant while the inhalation apparatus IA is in use, and prevent dirt and contaminants from entering the reclaim body assembly 120. In some embodiments, the reclaim housing 126 is sized and shaped such that the reclaim housing 126 surrounds the other components of the reclaim body assembly 120 and interfaces the upper and lower adapters 102 and 104. In other embodiments, the reclaim housing 126 can be any suitable size and shape.

As shown in FIG. 2, the upper opening of the reclaim housing 126 is enclosed during use when the material reclaim system 100 is assembled. The opening of the reclaim housing 126 interfaces an upper adapter cover 106 of the upper adapter 102 such that the inhalant is contained within the material reclaim system 100, and to prevent dirt and contaminants from entering the reclaim body assembly 120. Although the upper adapter cover 106 is depicted as combined with the upper adapter 102, in other embodiments, the upper adapter cover 106 is suitably a separate component that interfaces both the upper adapter 102 and the reclaim housing 126, or is suitably combined with any other component of the material reclaim system 100.

As shown most clearly in FIG. 5, in some embodiments, the reclaim housing 126 includes an articulating joint 128 near the interface of the reclaim housing 126 with the lower adapter cover 130 of the lower adapter 104. In embodiments, the articulating joint 128 is suitably coupled to the lower adapter cover 130 by any suitable coupling method, such as friction fit, turn to lock, magnetic, fasteners, or the like.

Figure 4:
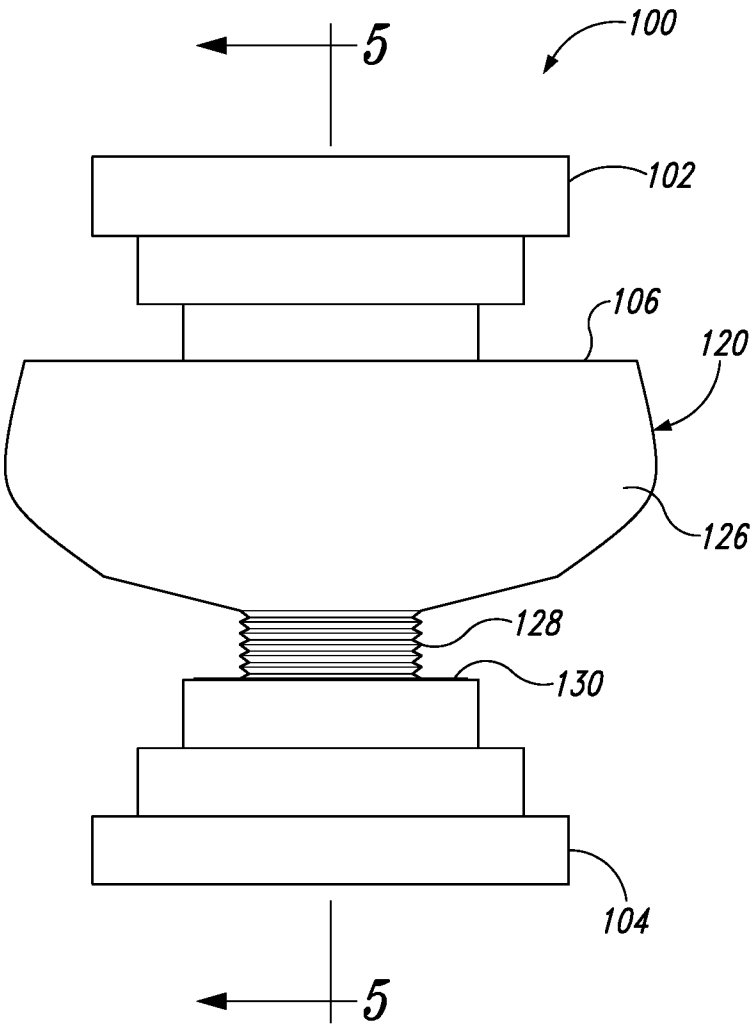
FIG. 4 is a front view of the material reclaim system of FIG. 1.

The articulating joint 128 is configured to articulate the material reclaim system 100 with respect to the lower adapter 104, as shown in FIG. 6. In this regard, the articulating joint 128 is suitably designed such that the material reclaim system 100 can be situated in a horizontal and level position as the angle of the inhalation apparatus inlet changes. In this regard, the reclaim bowl 124 can be positioned substantially level with respect to gravity to avoid escape of the reclaimed source material during use of the material reclaim system 100. In one exemplary embodiment shown in FIGS. 4-6, the articulating joint 128 comprises a corrugated configuration to articulate the material reclaim system 100 with respect to the lower adapter 104 and the inhalation apparatus inlet. In other embodiments, the articulating joint 128 comprises any suitable design to articulate the material reclaim system 100 with respect to the lower adapter 104 and the inhalation apparatus inlet, for example a pivoting joint, a slip joint, a flexible member, etc.

Returning to FIGS. 2 and 3, the reclaim body assembly 120 further includes the funnel member 122 positioned below and adjacent to the upper adapter cover 106. The funnel member 122 has a funnel spout 134 to direct the inhalant into the reclaim bowl 124. In use, as inhalant is drawn from the receptacle, through the inlet of the upper adapter 102, and into the reclaim body assembly 120 where the inhalant is directed through the central portion of the funnel member 122 and through the funnel spout 134. In the illustrated embodiment, the funnel member 122 is shown as a separate component in the reclaim body assembly 120; however, in other embodiments, the funnel member 122 and funnel spout 134 may be integrated with any other component of the material reclaim system, for example, with the upper adapter 102, the reclaim housing 126, or with the upper adapter cover 106. In additional embodiments, the funnel member 122 and funnel spout 134 have any shape suitable to direct the inhalant to the reclaim bowl 124. In this regard, the funnel spout 134 may be arcuate.

Figure 7:
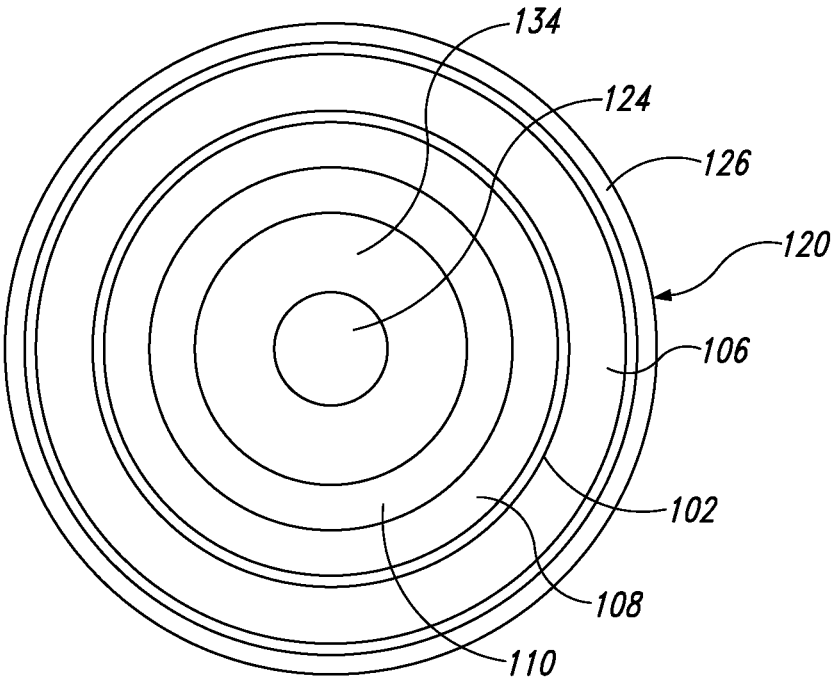
FIG. 7 is a top view of the material reclaim system of FIG. 1.
Figure 8:
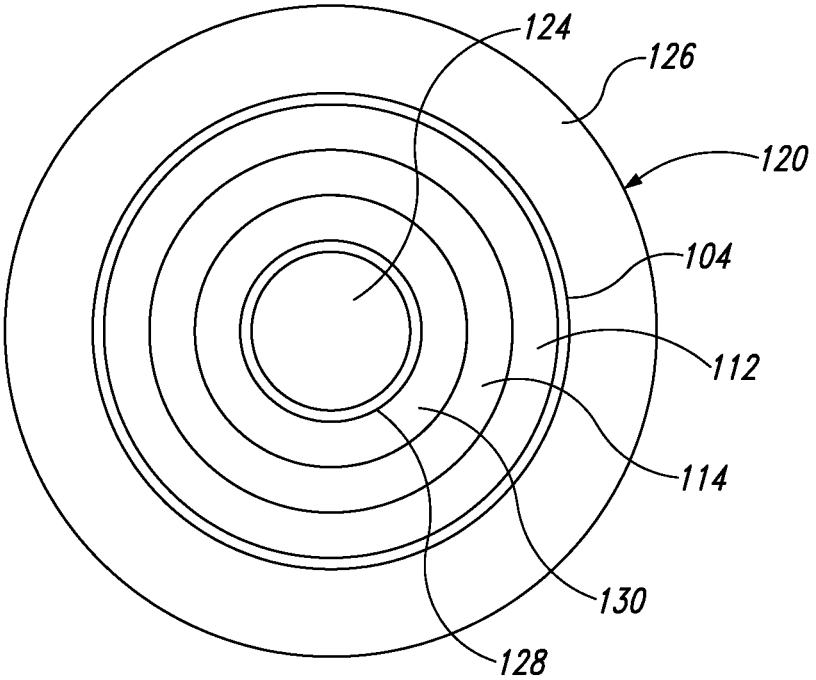
FIG. 8 is a bottom view of the material reclaim system of FIG. 1.

As described above, as the inhalant is drawn through the reclaim body assembly 120, the inhalant travels through the funnel spout 134 into the reclaim bowl 124 positioned below and adjacent to the funnel member 122 (see FIG. 7). The reclaim bowl 124 is configured to collect and contain excess source material, which may be liquid or solid, or inhalant that condensates within the reclaim body assembly 120, for reuse. The path of the inhalant passes through the funnel spout 134, as described above, and travels around the base of the reclaim bowl 124 before turning upwards to the reclaim bowl vent 132. When the inhalant exits the reclaim bowl vent 132, the inhalant travels along the reclaim housing 126 and out the lower adapter 104 to the inlet of the inhalation apparatus IA (see FIG. 8). In the illustrated embodiments, two opposing reclaim bowl vents 132 are shown; however, in other embodiments, a single reclaim bowl vent 132 or more than two reclaim bowl vents 132 are suitably included. Likewise, in further embodiments, the reclaim bowl 124 is configured to include a gap with the funnel member 122 such that a reclaim bowl vent 132 is not required.

The components of the material reclaim system 100, as described herein, are removably couplable such that the material reclaim system 100 can be disassembled and assembled for cleaning and recovery of the source material collected within the reclaim bowl 124. In this regard, in some embodiments, the components may be configured to interface with a gravity fit. In these embodiments, the components are suitably nested such that each component interface includes a feature to retain the next component without sliding radially or detaching from the system. In one example the reclaim housing 126 retains the reclaim bowl 124 and the funnel member 122 when the reclaim housing 126 is oriented such that the reclaim bowl 124 is upright, i.e., with the bowl portion opening upward with respect to the direction of gravity. In other embodiments, the components of the material reclaim system 100 are removably couplable to each other with any suitable non-permanent methodology, including press fit, turn-to-lock features, fasteners, and/or interlock features, among others.

Conventional inhalation apparatuses typically do not include any coupling feature on the inlet. In this regard, the material reclaim system 100 is configured to secure to the inlet by a sleeve fit where the first or second lower adapter seat 112 or 114 fits over the inlet of the inhalation apparatus IA to secure the material reclaim system 100. In other embodiments, where the inhalation apparatus IA includes a coupling feature, the lower adapter 104 is configured to interface the coupling feature of the inhalation apparatus IA. In a similar regard, conventional receptacles typically do not include any coupling feature that would interface the upper adapter 102. In this regard, the receptacle configured to secure to the upper adapter 102 by a sleeve fit where the first or second upper adapter seat 108 or 110 surrounds the receptacle. In other embodiments, where the receptacle includes a coupling feature, the upper adapter 102 is configured to interface the coupling feature of the receptacle.

In embodiments disclosed herein, the components of the material reclaim system 100 are manufactured from a material of one or more of High-Density Polyethylene (HDPE), Low-Density Polyethylene (LDPE), rubber, Polypropylene (PP), nylon, Acrylonitrile Butadiene Styrene (ABS), Polybutylene Terephthalate (PBT), metal, such as titanium or other high melting-point metals, glass, and any other suitable material. In some embodiments, the components of the material reclaim system 100 may comprise similar materials between each component; however, in other embodiments, more than one component may comprise dissimilar materials. Likewise, materials may be selected for the components of the material reclaim system 100 such that they are suitable with different inhalants; source materials; receptacle materials, temperature ranges, types, and sizes; and inhalation apparatus materials, types, and sizes.

The principles, representative embodiments, and modes of operation of the present disclosure were described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The invention claimed is:

1. A material reclaim system, comprising:

an inlet configured to draw an inhalant into the material reclaim system;

a funnel member positioned adjacent the inlet and having a funnel spout;

a reclaim bowl having an interior surrounding the funnel spout;

a vent extending through an upper portion of the reclaim bowl; and a housing surrounding the funnel member and the reclaim bowl, the housing comprising:
an articulating joint; and
an outlet for expelling the inhalant, wherein the funnel spout is configured to direct the inhalant into the reclaim bowl such that condensate collects therein, and wherein the vent fluidly couples the interior of the reclaim bowl and an interior of the housing such that inhalant is directed from the reclaim bowl into the housing.

2. The material reclaim system of claim 1, further comprising an upper adapter interfacing the inlet and configured to retain a receptacle containing a source material.

3. The material reclaim system of claim 2, wherein the upper adapter further comprises a receptacle adapter seat such that the receptacle abuts the adapter seat in a retained position.

4. The material reclaim system of claim 2, wherein the upper adapter further comprises a plate positioned adjacent the funnel member to enclose the reclaim housing.

5. The material reclaim system of claim 1, further comprising a lower adapter interfacing the outlet and configured to removably couple the material reclaim system to an inhalation apparatus.

6. The material reclaim system of claim 5, wherein the lower adapter further comprises an inhalation apparatus adapter seat such that the inhalation apparatus abuts the inhalation apparatus adapter seat when the material reclaim system is coupled to the inhalation apparatus.

7. The material reclaim system of claim 5, wherein the articulating joint is configured to position the material reclaim system at an angle compared to the inhalation apparatus.

8. The material reclaim system of claim 1, wherein the vent is positioned above an outlet of the funnel spout.

9. The material reclaim system of claim 1, wherein the funnel, reclaim bowl, and housing are in a nested configuration.

10. The material reclaim system of claim 1, wherein the system is manufactured from one or more of High-Density Polyethylene (HDPE), Low-Density Polyethylene (LDPE), rubber, Polypropylene (PP), nylon, Acrylonitrile Butadiene Styrene (ABS), Polybutylene Terephthalate (PBT), metal, and glass.

11. A material reclaim system for an inhalation apparatus, comprising:

an upper adapter having an inlet configured to draw an inhalant into the material reclaim system, the upper adapter configured to retain a receptacle containing a source material;

a funnel member positioned adjacent the inlet and having a funnel spout;

a reclaim bowl having an interior surrounding the funnel spout;

a vent extending through an upper portion of the reclaim bowl;

a housing surrounding the funnel member and the reclaim bowl; and a lower adapter couplable to the housing and having an outlet configured to expel the inhalant, the lower adapter configured to interface the material reclaim system with the inhalation apparatus, wherein the funnel spout is configured to direct the inhalant into the reclaim bowl such that condensate collects therein, and wherein the vent fluidly couples the interior of the reclaim bowl and an interior of the housing such that inhalant is directed from the reclaim bowl into the housing.

12. The material reclaim system of claim 11, further comprising an articulating joint between the housing and the lower adapter, wherein the articulating joint is configured to position the material reclaim system at an angle compared to the inhalation apparatus.

13. The material reclaim system of claim 11, wherein the upper adapter further comprises a receptacle adapter seat such that the receptacle abuts the adapter seat in a retained position.

14. The material reclaim system of claim 11, wherein the upper adapter further comprises a plate positioned adjacent the funnel member to enclose the reclaim housing.

15. The material reclaim system of claim 11, wherein the lower adapter further comprises an inhalation apparatus adapter seat such that the inhalation apparatus abuts the inhalation apparatus adapter seat when the material reclaim system is coupled to the inhalation apparatus.

16. The material reclaim system of claim 11, wherein the vent is positioned above an outlet of the funnel spout.

17. The material reclaim system of claim 11, wherein the funnel, reclaim bowl, and housing are in a nested configuration.

18. The material reclaim system of claim 11, wherein the system is manufactured from one or more of High-Density Polyethylene (HDPE), Low-Density Polyethylene (LDPE), rubber, Polypropylene (PP), nylon, Acrylonitrile Butadiene Styrene (ABS), Polybutylene Terephthalate (PBT), metal, and glass.

* * * * *